US012338049B2

(12) United States Patent
Laudy

(10) Patent No.: US 12,338,049 B2
(45) Date of Patent: Jun. 24, 2025

(54) FAST FOOD CARRYING ASSEMBLY

(71) Applicant: Scott Laudy, Winnipeg (CA)

(72) Inventor: Scott Laudy, Winnipeg (CA)

( * ) Notice: Subject to any disclaimer, the term of this patent is extended or adjusted under 35 U.S.C. 154(b) by 205 days.

(21) Appl. No.: 18/142,658

(22) Filed: May 3, 2023

(65) Prior Publication Data

US 2024/0367880 A1 Nov. 7, 2024

(51) Int. Cl.

| | |
|---|---|
| ***B65D 25/24*** | (2006.01) |
| ***B65D 1/34*** | (2006.01) |
| ***B65D 25/30*** | (2006.01) |
| ***B65D 71/70*** | (2006.01) |

(52) U.S. Cl.

CPC ..... *B65D 71/70* (2013.01); *B65D 1/34* (2013.01); *B65D 25/24* (2013.01); *B65D 25/30* (2013.01)

(58) Field of Classification Search

CPC ..... A47B 3/06; A47B 31/06; A47G 23/0608; B65D 1/72; B65D 71/70; B65D 25/24; B65D 25/30

See application file for complete search history.

(56) References Cited

U.S. PATENT DOCUMENTS

| | | | | |
|---|---|---|---|---|
| 3,103,303 | A | 9/1963 | Lynchey | |
| 3,318,456 | A * | 5/1967 | Lipe | B60N 3/002 297/188.2 |
| D309,258 | S | 7/1990 | Vigue | |
| 5,765,689 | A | 6/1998 | Cobden | |
| 6,131,732 | A | 10/2000 | Schneider | |
| 6,401,927 | B1 * | 6/2002 | Sorensen | B65D 5/5286 273/286 |
| D690,107 | S * | 9/2013 | Scott | D3/304 |
| D737,104 | S | 8/2015 | Sobotka | |
| D865,451 | S | 11/2019 | Thompson | |
| D923,414 | S * | 6/2021 | Luciano | D7/553.4 |
| 2002/0027366 | A1 | 3/2002 | Bieri | |
| 2016/0287024 | A1 * | 10/2016 | Bach | A47G 23/0625 |
| 2020/0046115 | A1 * | 2/2020 | Thorpe | A47B 3/06 |

FOREIGN PATENT DOCUMENTS

| | | |
|---|---|---|
| GB | 2365754 | 2/2002 |

* cited by examiner

*Primary Examiner* — Corey N Skurdal

(57) ABSTRACT

A fast food carrying assembly includes a panel that has a pair of hand openings which can be gripped by a user such that the user can extend the panel into a drive through window at a fast food restaurant. The panel has a plurality of beverage holes to insertably receive a beverage container when the user extends the panel into the drive through window. A modular stand is positionable on a support surface thereby facilitating the panel to be placed on the modular stand to facilitate the beverage containers and the food bag to be accessible to the user. Additionally, the modular stand includes a plurality of pieces that are removably attachable together.

6 Claims, 9 Drawing Sheets

FAST FOOD CARRYING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to carrying devices and more particularly pertains to a new carrying device for facilitating a driver of a vehicle to receive fast food at a drive through window without touching the server. The device additionally facilitates beverage containers and a food bag to be securely stored in the vehicle while the vehicle is driving.

(2) Description of Related Art Including Information Disclosed Under 37 CFR 1.97 and 1.98

The prior art relates to carrying devices including a variety of beverage tray devices that each has a plurality of holding holes for receiving beverage cups. In no instance does the prior art disclose a beverage holder that includes a modular stand for supporting the beverage holder in a vehicle.

BRIEF SUMMARY OF THE INVENTION

An embodiment of the disclosure meets the needs presented above by generally comprising a panel that has a pair of hand openings which can be gripped by a user such that the user can extend the panel into a drive through window at a fast food restaurant. The panel has a plurality of beverage holes to insertably receive a beverage container when the user extends the panel into the drive through window. A modular stand is positionable on a support surface thereby facilitating the panel to be placed on the modular stand to facilitate the beverage containers and the food bag to be accessible to the user. Additionally, the modular stand includes a plurality of pieces that are removably attachable together.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
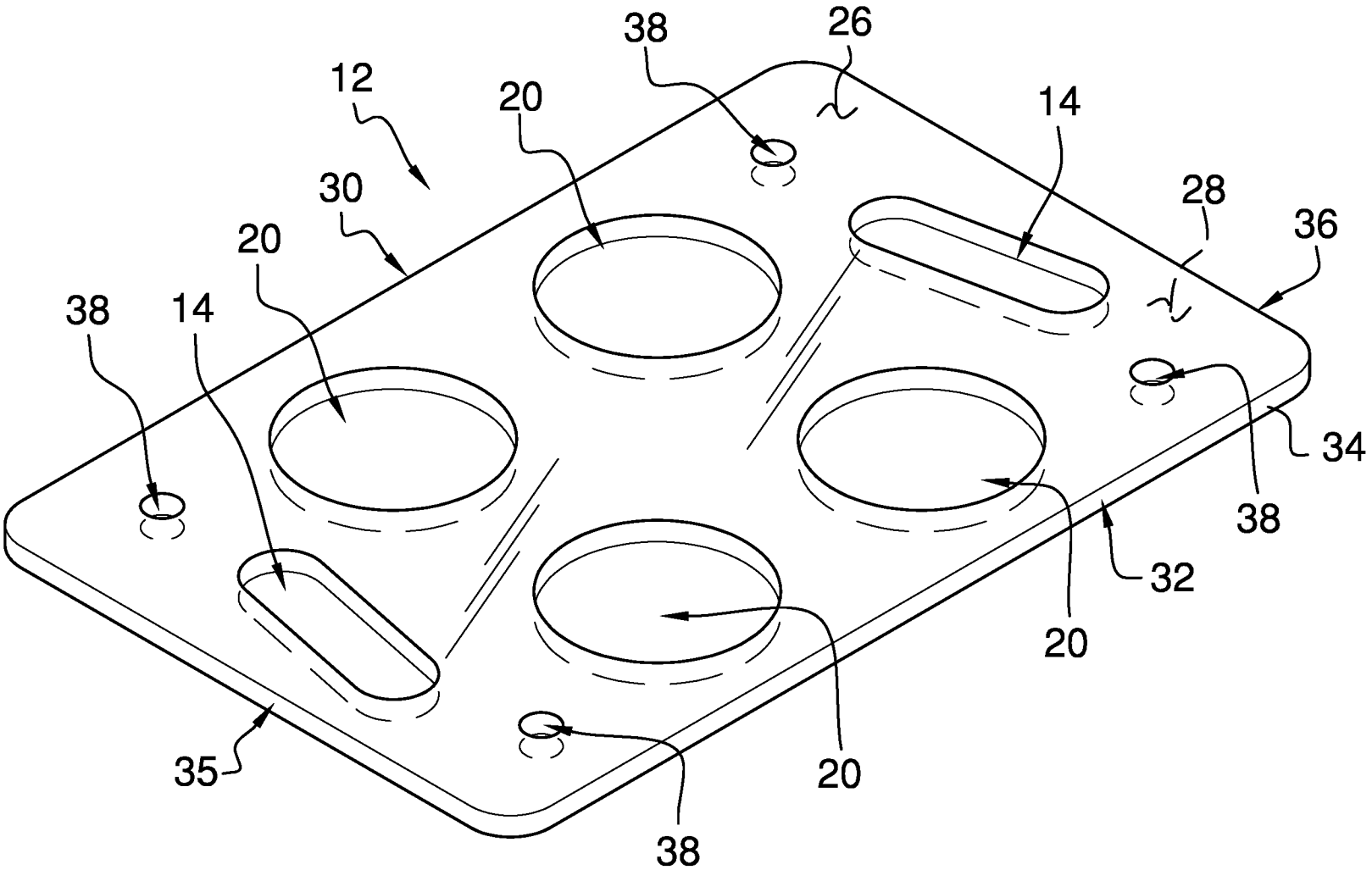
FIG. 1 is a top perspective view of panel of a fast food carrying assembly according to an embodiment of the disclosure.
Figure 2:
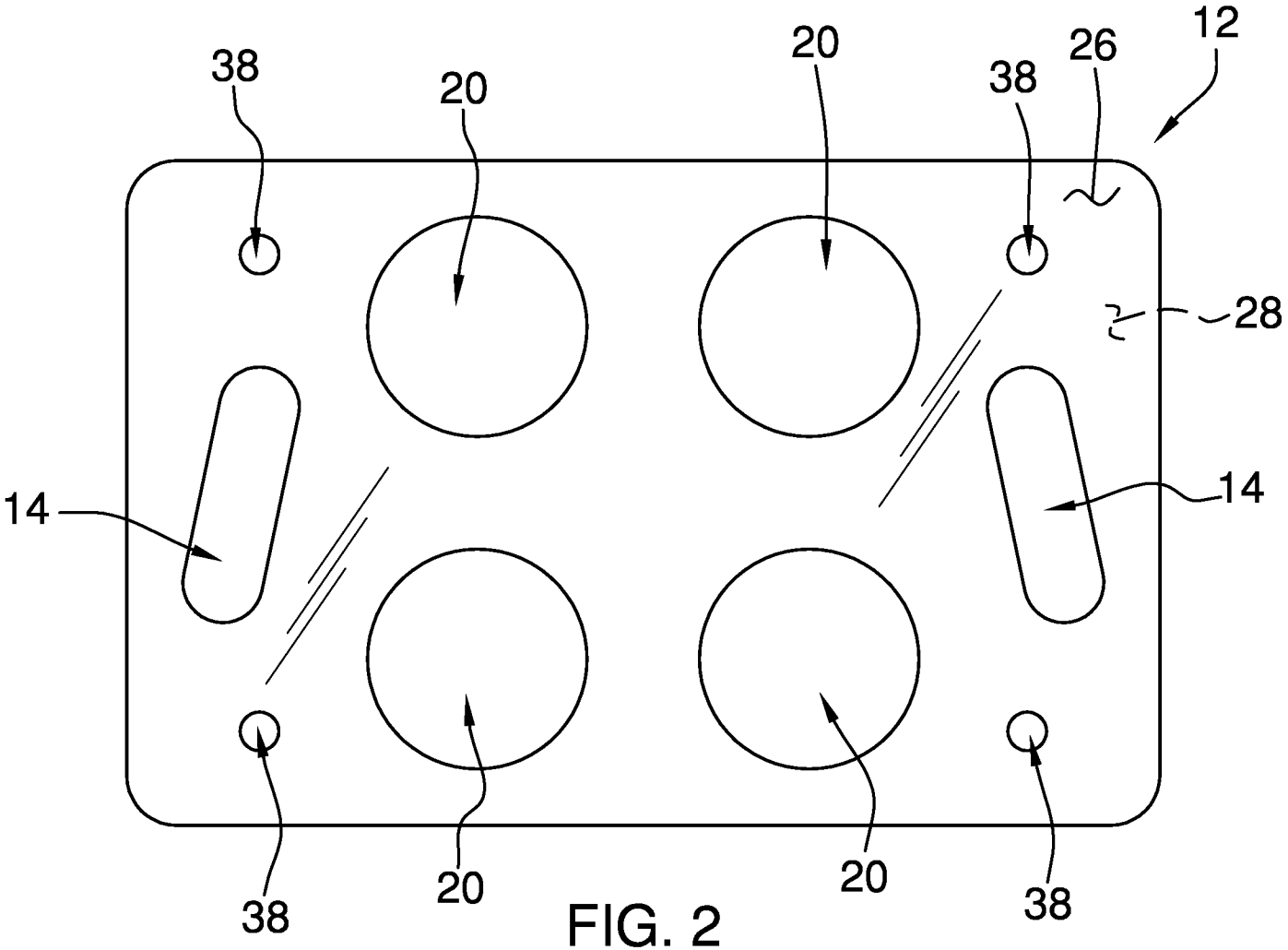
FIG. 2 is a top view of a panel of an embodiment of the disclosure.
Figure 3:
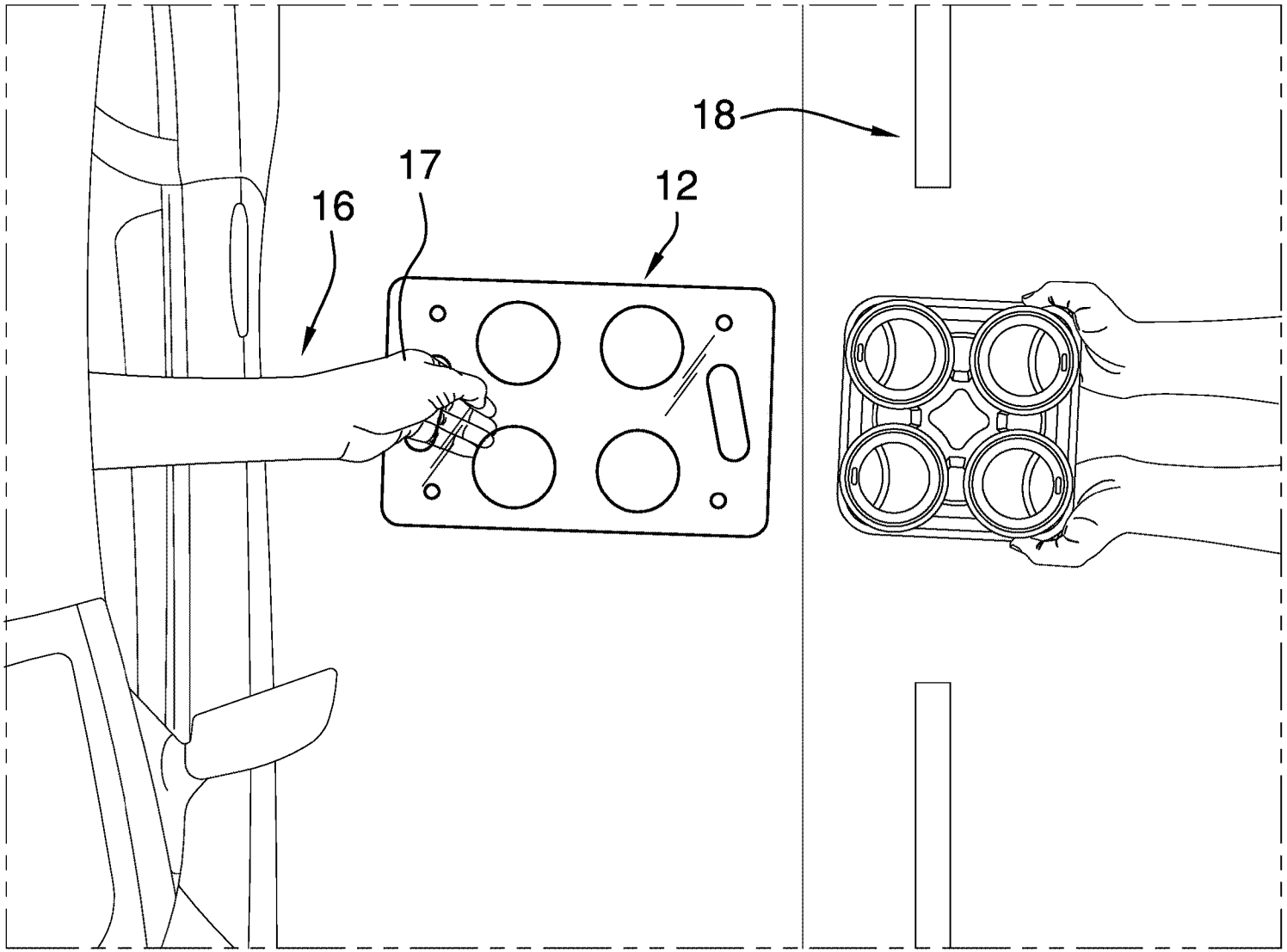
FIG. 3 is a perspective in-use view of an embodiment of the disclosure showing a user handing a panel to a server at a drive through window.
Figure 3A:
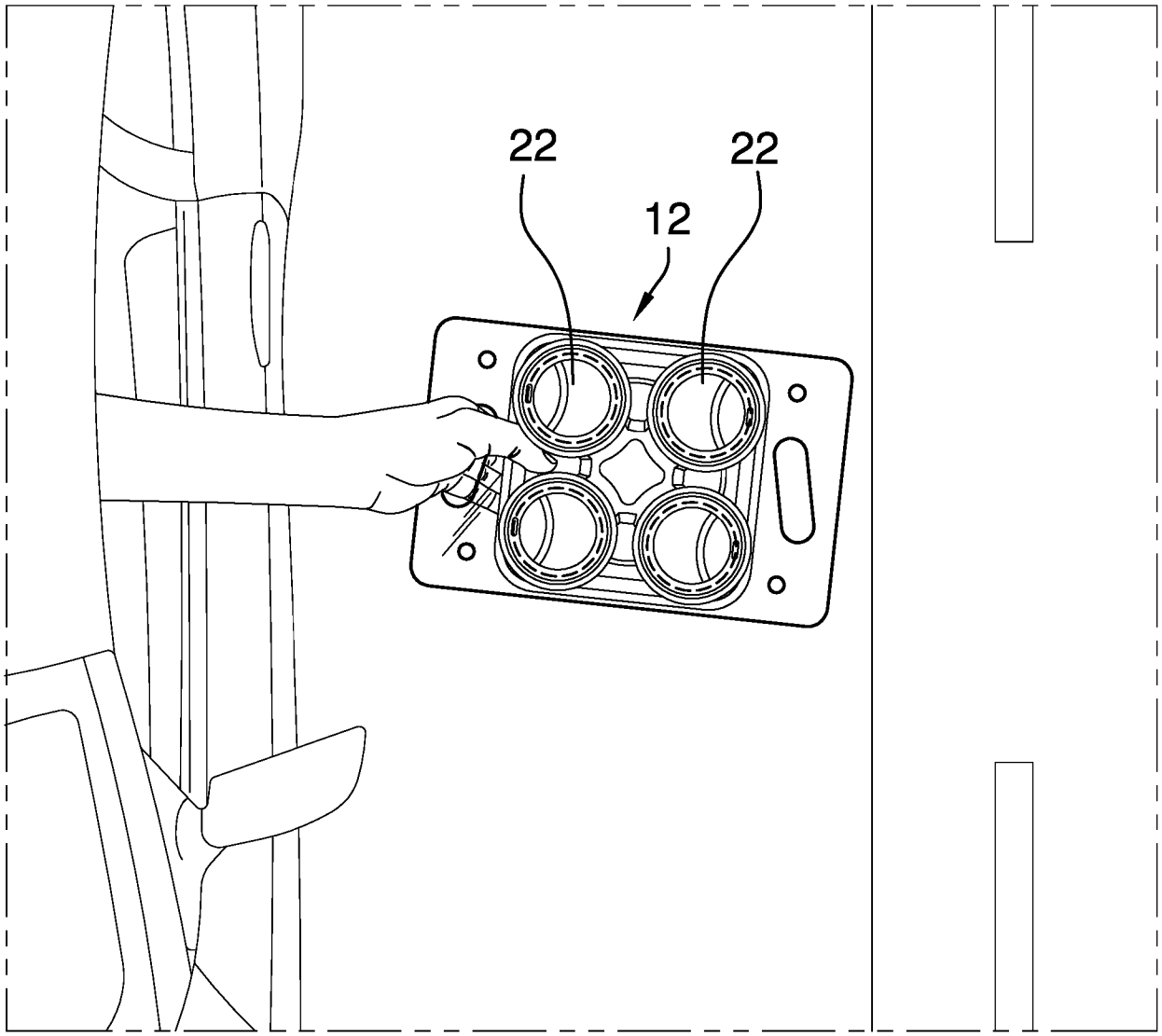
FIG. 3A is a perspective in-use view of an embodiment of the disclosure showing a user retrieving a plurality of beverage containers on a panel.
Figure 4:
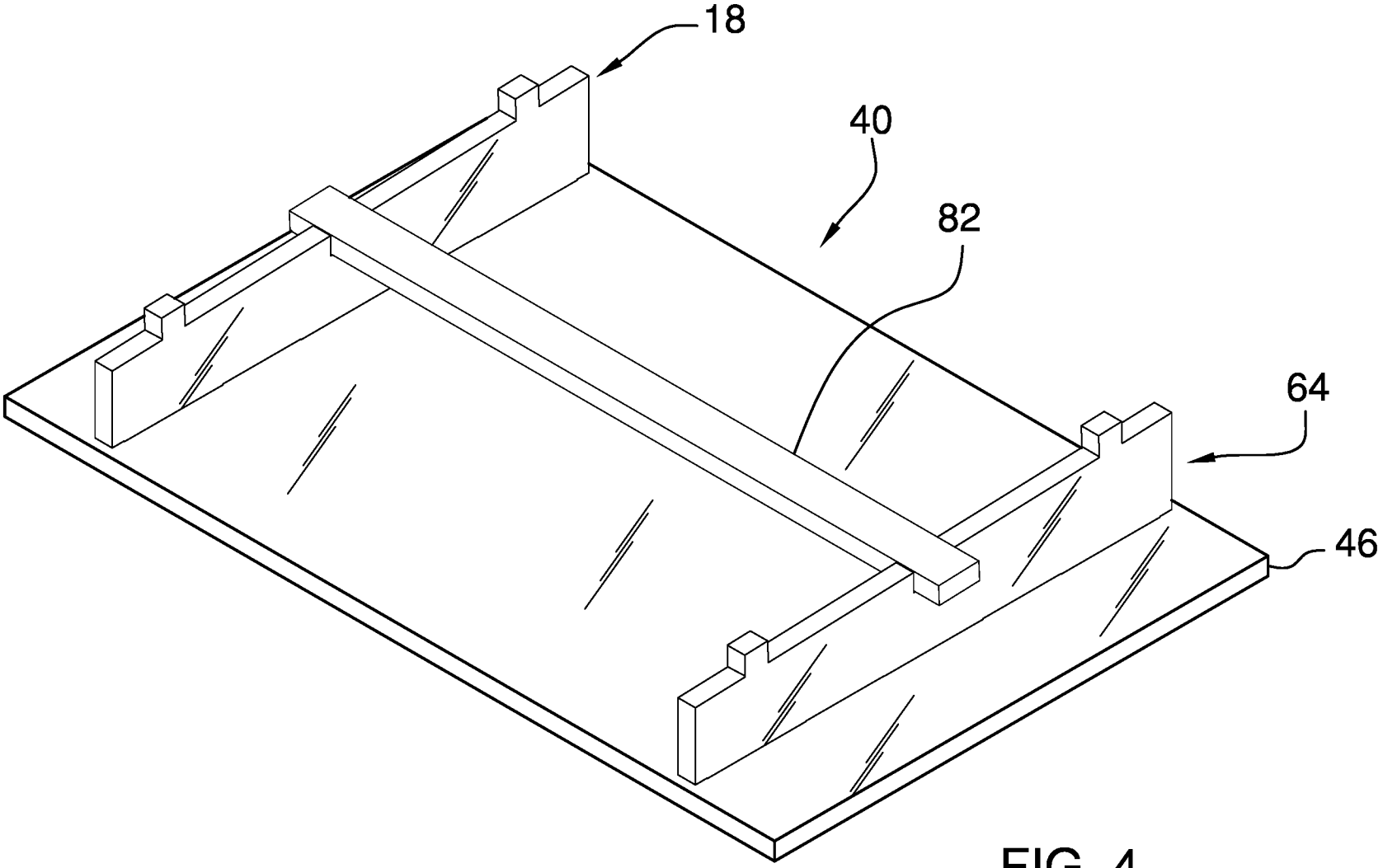
FIG. 4 is a top perspective view of a modular stand of an embodiment of the disclosure.
Figure 5:
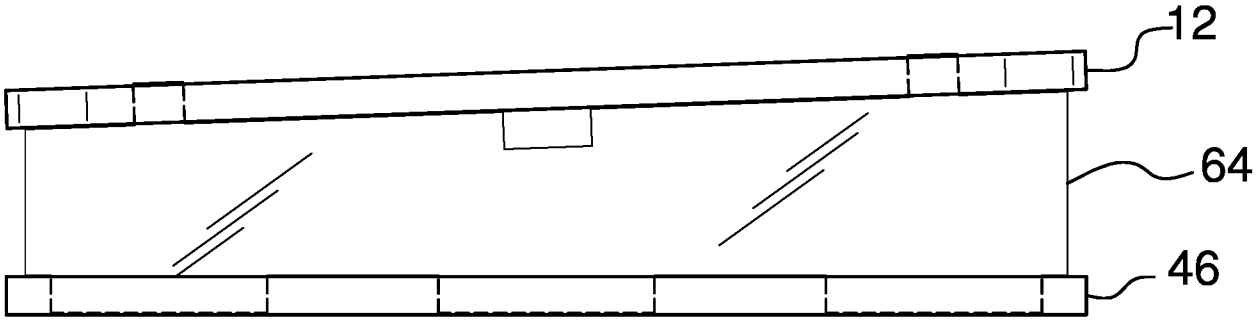
FIG. 5 is a left side view of an embodiment of the disclosure.
Figure 6:
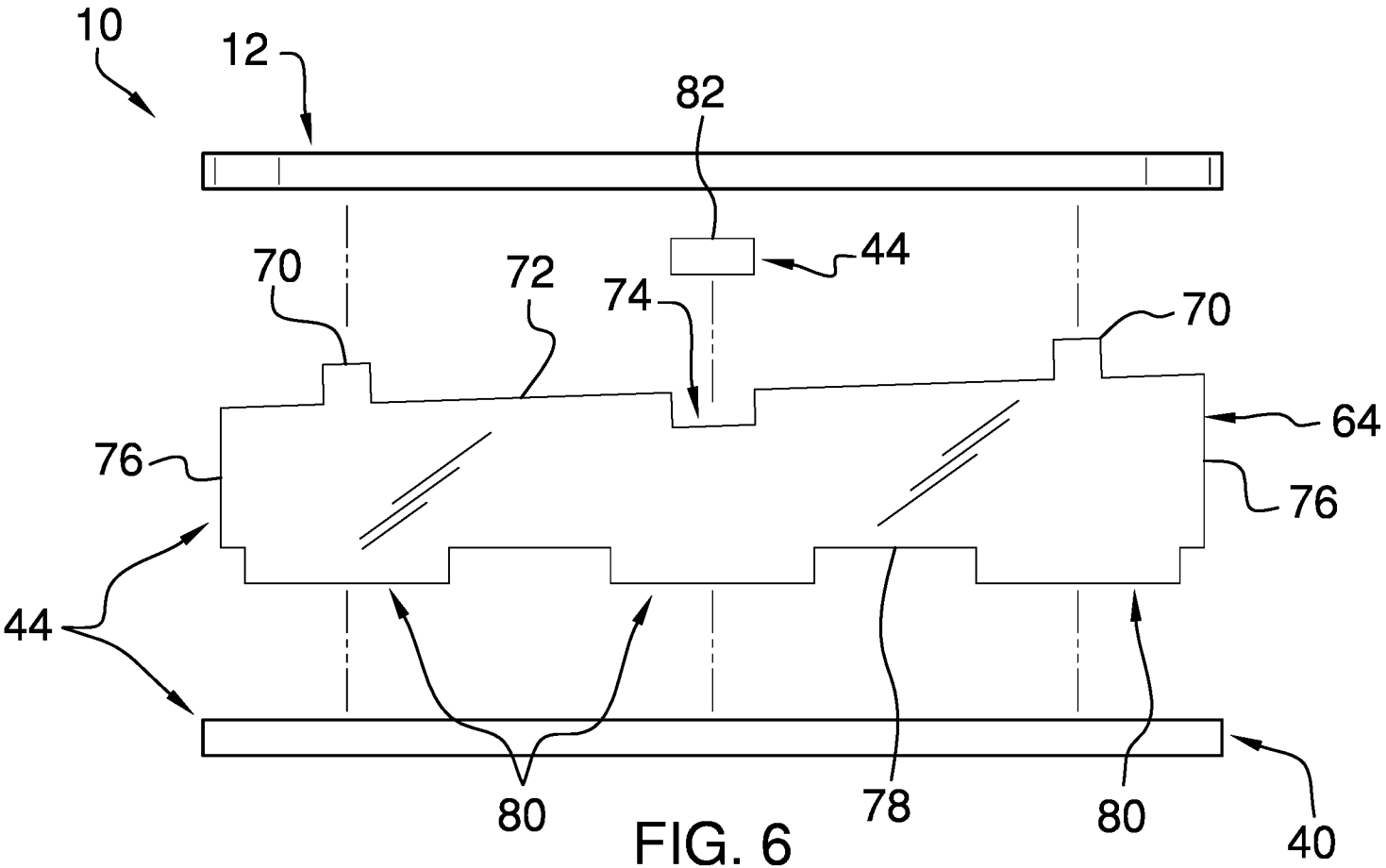
FIG. 6 is an exploded view of an embodiment of the disclosure.
Figure 7:
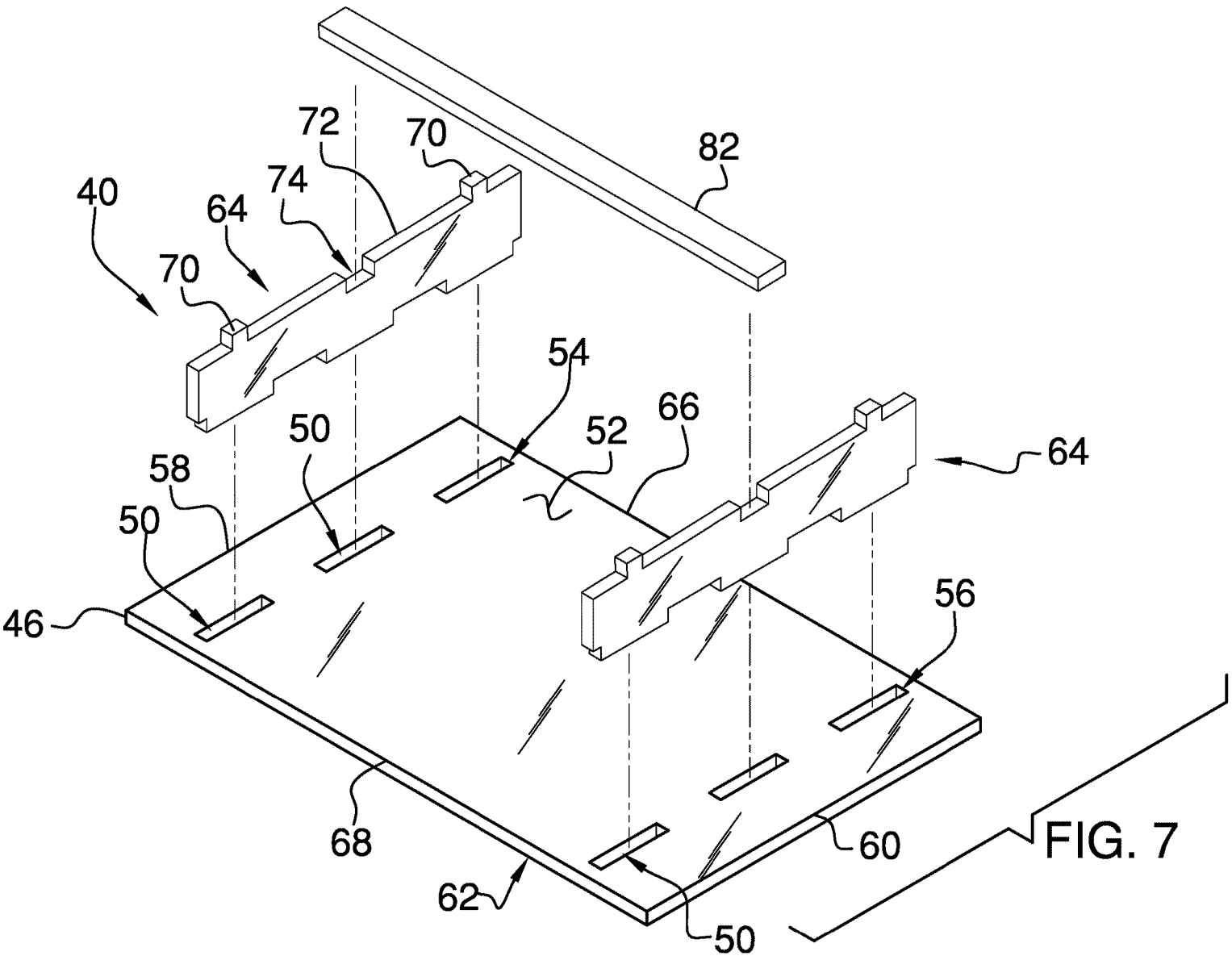
FIG. 7 is an exploded view of modular stand of an embodiment of the disclosure.
Figure 8:
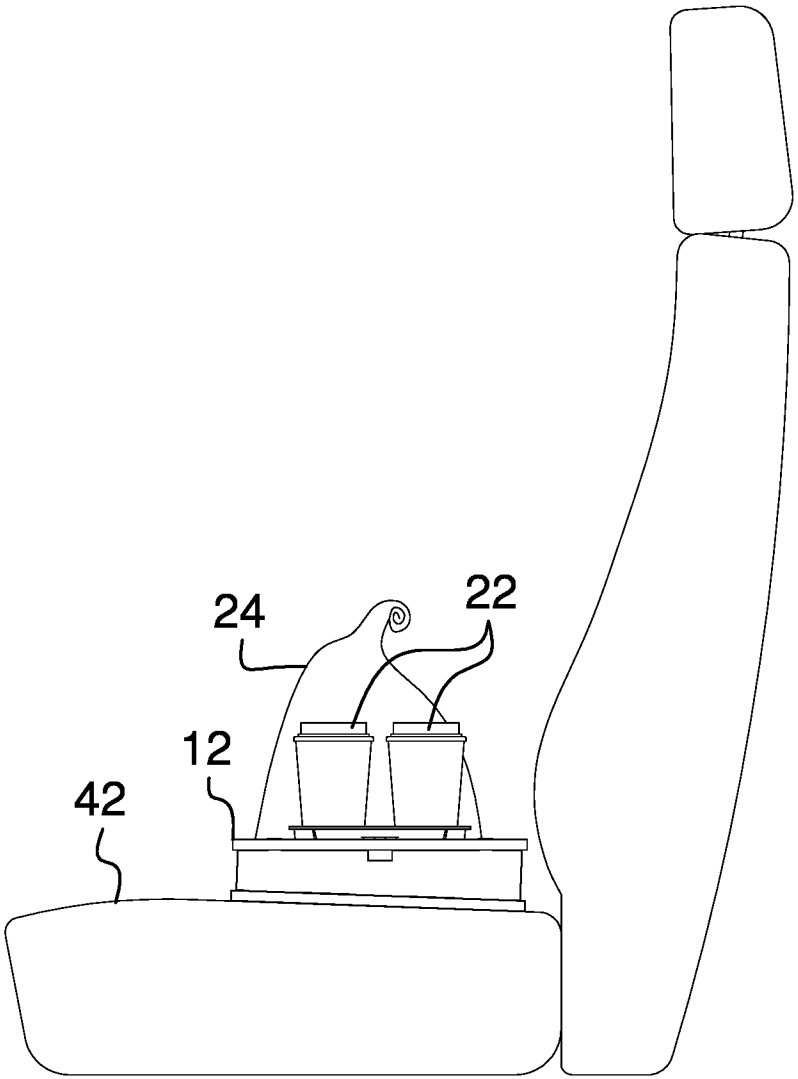
FIG. 8 is a perspective in-use view of an embodiment of the disclosure.

With reference now to the drawings, and in particular to FIGS. 1 through 8 thereof, a new carrying device embodying the principles and concepts of an embodiment of the disclosure and generally designated by the reference numeral 10 will be described.

As best illustrated in FIGS. 1 through 8, the fast food carrying assembly 10 generally comprises a panel 12 that has a pair of hand openings 14 to facilitate the user 16 to slide one of their hands 17 through either of the hand openings 14. In this way the user 16 can support the panel 12 on a horizontal plane such that the user 16 can extend the panel 12 into a drive through window 18 at a fast food restaurant. The panel 12 has a plurality of beverage holes 20 that each has a pre-determined diameter to insertably receive a beverage container 22 when the user 16 extends the panel 12 into the drive through window 18. In this way the user 16 can easily hold several beverage containers 22. The panel 12 is comprised of a rigid material to support the weight of the beverage containers 22 and a food bag 24 placed on the panel 12.

Each of the hand openings 14 extends through a top surface 26 and a bottom surface 28 of the panel 12 and each of the hand openings 14 is elongated such that each of the hand openings 14 has an ovoid shape. Each of the hand openings 14 is spaced from a respective one of a front side 30 and a back side 32 of a perimeter edge 34 of the panel 12 and each of the hand openings 14 is oriented to angle away from the respective front side 30 and back side 32 along a line extending between a first lateral side 35 and a second lateral side 36 of the perimeter edge 34 of the panel 12. Each of the plurality of beverage holes 20 extends through the top surface 26 and the bottom surface 28 of the panel 12. Additionally, the plurality of beverage holes 20 is arranged to define four corners of a square that is positioned between the pair of hand openings 14. The panel 12 has a plurality of engagement holes 38 each extending through the top surface 26 and the bottom surface 28 of the panel 12 and each of the engagement holes 38 is positioned proximate a respective one of four corners of the panel 12.

A modular stand 40 is positionable on a support surface 42 thereby facilitating the panel 12 to be placed on the modular stand 40 to facilitate the beverage containers 22 and the food bag 24 to be accessible to the user 16. The modular stand 40 includes a plurality of pieces 44 that can be removably attached together. The plurality of pieces 44 comprises a plate 46 which has a bottom side 48 that rests on the support surface 42. The support surface 42 may be a passenger seat of a vehicle or other horizontal support surface 42 inside of the vehicle that is immediately accessible to the user 16. The plate 46 has a plurality of wells 50 each extending downwardly into a top surface 52 of the plate 46 and the plurality of wells 50 includes a first set of wells 54 and a second set of wells 56. Each of the first set of wells 54 and the second set of wells 56 are distributed along a respective one of a first lateral side 58 and a second lateral side 60 of an outer edge 62 of the plate 46.

The plurality of pieces 44 includes a pair of supports 64 which each extends upwardly from the top surface 52 of the plate 46. Each of the pair of supports 64 is elongated to extend between a forward side 66 and a rear side 68 of the outer edge 62 of the plate 46. Each of the pair of supports 64 is spaced from a respective one of the first lateral side 58 and the second lateral side 60 of the outer edge 62 of the plate 46. Each of the supports 64 has a pair of first tabs 70 which extend upwardly from an upper edge 72 of the supports 64.

The upper edge 72 of each of the supports 64 has a notch 74 extending toward the top surface 26 of the plate 46 and the notch 74 is centrally positioned along the upper edge 72. Each of the pair of first tabs 70 on a respective one of the pair of supports 64 is positioned adjacent to opposing ends 76 of the respective support 64. Additionally, each of the pair of first tabs 70 associated with each of the supports 64 extends into a respective one of the engagement holes 38 in the panel 12 when the panel 12 is placed on the modular stand 40 for retaining the panel 12 on the modular stand 40. A lower edge 78 of each of the supports 64 is crenellated and each of the crenellations 80 associated with each of the supports 64 extends into a respective one of the wells 50 in the top surface 26 of the plate 46. In this way each of the supports 64 is retained on the top surface 26 of the plate 46. The plurality of pieces 44 includes a support member 82 that is positionable in the notch 74 in the upper edge 72 of each of the supports 64 such that the support member 82 extends between the pair of supports 64. The bottom surface 28 of the panel 12 rests on the support member 82 when the panel 12 is positioned on the modular stand 40.

In use, the user 16 slides their hand 17 downwardly through a respective one of the hand openings 14 such that the user 16 can hold the panel 12 on a horizontal plane. In this way the user 16 can pass the panel 12 into the drive through window 18 of the fast food restaurant. A server 84 in the fast food restaurant places the beverage containers 22 in the plurality of beverage holes 20 and the food bag 24 on the panel 12. In this way the server 84 and the user 16 do not have to make physical contact with each other to reduce transmission of germs between each other. Furthermore, the panel 12 facilitates the user 16 to support the beverage containers 22 and the food bag 24 while the user 16 maneuvers the panel 12 to rest the panel 12 on the modular stand 40. In this way the user 16 can transport the beverage containers 22 and the food bag 24 in a vehicle without spilling.

do

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fast food carrying assembly for receiving a fast food order at a drive through window, said assembly comprising:

a panel having a pair of hand openings wherein a respective one of said hand openings is configured to be gripped by a user having said panel lying on a horizontal plane such that the user can extend said panel into a drive through window at a fast food restaurant, said panel having a plurality of beverage holes each having a pre-determined diameter wherein each of said beverage holes is configured to insertably receive a beverage container when the user extends said panel into the drive through window, said panel being comprised of a rigid material wherein said panel is configured to support the weight of the beverage containers and a food bag placed on said panel;

a modular stand being positionable on a support surface thereby facilitating said panel to be placed on said modular stand wherein said panel is configured to facilitate the beverage containers and the food bag to be accessible to the user, said modular stand including a plurality of pieces being removably attachable together; and wherein said plurality of pieces comprises a plate having a bottom side which rests on the support surface, a pair of supports, each of said pair of supports extending upwardly from a top surface of said plate, and a support member being positionable to extend between said pair of supports.

2. The assembly according to claim 1, wherein:

each of said hand openings extends through a top surface and a bottom surface of said panel, each of said hand openings being elongated such that each of said hand openings has an ovoid shape, each of said hand openings being spaced from a respective one of a front side and a back side of a perimeter edge of said panel, each of said hand openings being oriented to angle away from said respective front side and back side along a line extending between a first lateral side and a second lateral side of said perimeter edge of said panel;

each of said plurality of beverage holes extends through said top surface and said bottom surface of said panel, said plurality of beverage holes being arranged to define four corners of a square being positioned between said pair of hand openings; and said panel has a plurality of engagement holes each extending through said top surface and said bottom surface of said panel, each of said engagement holes being positioned proximate a respective one of four corners of said panel.

3. The assembly according to claim 1, wherein:

each of said pair of supports is elongated to extend between a forward side and a rear side of an outer edge of said plate, each of said pair of supports being spaced from a respective one of a first lateral side and a second lateral side of said outer edge of said plate;

each of said supports has a pair of first tabs extending upwardly from an upper edge of said supports, each of said pair of first tabs on a respective one of said pair of supports is positioned adjacent to opposing ends of said respective support; and said upper edge of each of said supports having a notch extending toward said top surface of said plate, said notch being centrally positioned along said upper edge.

4. The assembly according to claim 3, wherein said support member is positionable in said notch in said upper edge of each of said supports such that said support member extends between said pair of supports, said bottom surface of said panel resting on said support member when said panel is positioned on said modular stand.

5. The assembly according to claim 3, wherein:

said panel has a plurality of engagement holes extending through said panel; and each of said pair of first tabs associated with each of said supports extends into a respective one of said engagement holes in said panel when said panel is placed on said modular stand for retaining said panel on said modular stand.

6. A fast food carrying assembly for receiving a fast food order at a drive through window, said assembly comprising:

a panel having a pair of hand openings wherein a respective one of said hand openings is configured to be gripped by a user having said panel lying on a horizontal plane such that the user can extend said panel into a drive through window at a fast food restaurant, said panel having a plurality of beverage holes each having a pre-determined diameter wherein each of said beverage holes is configured to insertably receive a beverage container when the user extends said panel into the drive through window, said panel being comprised of a rigid material wherein said panel is configured to support the weight of the beverage containers and a food bag placed on said panel, each of said hand openings extending through a top surface and a bottom surface of said panel, each of said hand openings being elongated such that each of said hand openings has an ovoid shape, each of said hand openings being spaced from a respective one of a front side and a back side of a perimeter edge of said panel, each of said hand openings being oriented to angle away from said respective front side and back side along a line extending between a first lateral side and a second lateral side of said perimeter edge of said panel, each of said plurality of beverage holes extending through said top surface and said bottom surface of said panel, said plurality of beverage holes being arranged to define four corners of a square being positioned between said pair of hand openings, said panel having a plurality of engagement holes each extending through said top surface and said bottom surface of said panel, each of said engagement holes being positioned proximate a respective one of four corners of said panel; and a modular stand being positionable on a support surface thereby facilitating said panel to be placed on said modular stand wherein said panel is configured to facilitate the beverage containers and the food bag to be accessible to the user, said modular stand including a plurality of pieces being removably attachable together, said plurality of pieces comprising:

a plate having a bottom side which rests on the support surface;

a pair of supports, each of said pair of supports extending upwardly from a top surface of said plate, each of said pair of supports being elongated to extend between a forward side and a rear side of an outer edge of said plate, each of said pair of supports being spaced from a respective one of a first lateral side and a second lateral side of said outer edge of said plate, each of said supports having a pair of first tabs extending upwardly from an upper edge of said supports, said upper edge of each of said supports having a notch extending toward said top surface of said plate, said notch being centrally positioned along said upper edge, each of said pair of first tabs on a respective one of said pair of supports being positioned adjacent to opposing ends of said respective support, each of said pair of first tabs associated with each of said supports extending into a respective one of said engagement holes in said panel when said panel is placed on said modular stand for retaining said panel on said modular stand; and a support member being positionable in said notch in said upper edge of each of said supports such that said support member extends between said pair of supports, said bottom surface of said panel resting on said support member when said panel is positioned on said modular stand.

* * * * *